United States Patent [19]

Wehr et al.

[11] 4,454,808

[45] Jun. 19, 1984

[54] FEED DEVICE FOR STRAPPING BANDS

[75] Inventors: Hubert Wehr, Bornheim; Rolf-Günther Fritze, Koln, both of Fed. Rep. of Germany

[73] Assignee: Cyklop International Emil Hoffmann KG, Fed. Rep. of Germany

[21] Appl. No.: 376,579

[22] Filed: May 10, 1982

[30] Foreign Application Priority Data

May 12, 1981 [DE] Fed. Rep. of Germany ..... 3118713

[51] Int. Cl.[3] ..... B65B 13/04

[52] U.S. Cl. ..... 100/4; 100/26; 226/25

[58] Field of Search ..... 100/4, 25, 26; 226/10, 226/24, 35, 25, 37, 191

[56] References Cited

U.S. PATENT DOCUMENTS

| | | | |
|---|---|---|---|
| 3,004,728 | 10/1961 | Ihle | 226/25 X |
| 3,272,113 | 9/1966 | Otto | 100/26 |
| 4,145,963 | 3/1979 | Leslie | 100/26 X |

*Primary Examiner*—Billy J. Wilhite

*Attorney, Agent, or Firm*—Robert S. Lipton

[57] ABSTRACT

A feed device for strapping bands for use in strapping machines is disclosed. A pressure device and a feed roller push the strapping band into a band channel behind the feed roller. A disengaging lever is connected to the pressure device so that when a loop in the band is formed in the band channel, it moves the disengaging lever causing the pressure device to be withdrawn from the band and feed roller permitting the band to reverse direction causing the loop to disappear.

7 Claims, 2 Drawing Figures

FEED DEVICE FOR STRAPPING BANDS

BACKGROUND OF THE INVENTION

The invention relates to a feed device for strapping bands in strapping machines having a drive-operated feed roller and a contact pressure device cooperating therewith, which push the strapping band through a band channel behind the feed roller towards a stop.

In known strapping machines of the prior art the strapping band is fed through a band channel which encircles the package to be strapped. At the end of the band channel the strapping band runs against a stop, which is in the form of a switch which brings the band feed mechanism to a standstill. With the high belt speeds at which modern strapping machines operate, even with only a slight switch delay, one cannot avoid the band being advanced a little further, thus causing the band to bulge in the band channel if its front end is retained by the stop switch. Such loops or bulges, also referred to herein as "band loops", in the band channel give rise to breakdowns and can lead to the impossibility of any proper strapping being made with the end of the band remaining in the band channel.

SUMMARY OF THE INVENTION

The purpose of the invention is to provide a feed device for strapping bands in such a way that the likelihood of formation of loops in the band channel is minimized and that any loops which do form can be quickly removed immediately after their formation.

This purpose is achieved by the present invention by providing a disengaging lever which is movable by a band loop formed in the band channel and which removes the pressure device from the feed roller.

This design has the advantage that a band loop, formed in the band channel behind the feed roller due to the overrunning of the band feed mechanism, is automatically eliminated. This is due to the strapping bands elasticity and its tendency to resume its extended flat position which causes it to slip backwards in the gap between feed roller and pressure device as soon as the band loop has removed the pressure device from the feed roller via the lever. The strapping band thus always assumes a completely flat position in the band channel.

It is particularly expedient if the disengaging lever is moved by a band guide strip, which covers one section of the band channel and is displaced by the band loop as it is formed. This embodiment of the invention has the advantage of the strapping band not losing its lateral and upper guide in the region of the band where the loop is being formed.

The disengaging lever which removes the pressure device from the feed roller can be a swivel lever or lever which is pivotally mounted at the end near the pressure device. The pressure device includes a spring which forces it against the feed roller. It is thus possible to select the lever mechanical advantage such that the pressure device can be lifted off of the feed roller so that the relatively strong pressure of the spring, which is necessary for proper band feed, is counteracted.

A particularly simple construction is produced if the band guide strip is swivel or pivot mounted at one end, and if the disengaging lever has at its one end a supporting roller, against which the free end of the band guide strip presses and along which it moves with its swivel motion.

The pressure device can be mounted on a spring-loaded pressure lever, having a stop upon which the disengaging lever acts. In particular cases it can be expedient if the disengaging lever itself covers a section of the band channel and is directly moved or actuated by the band loop which forms. The disengaging lever itself then expediently serves as a band guide.

In accordance with the present invention the band loops all form directly down stream or behind the feed roller. Therefore, the disengaging lever is similarly positioned behind the feed roller.

Further features and advantages of the invention can be seen in the following description and the drawing, which describe a particularly suitable embodiment of the invention.

DESCRIPTION OF THE PREFERRED EMBODIMENT

Figures 1, 2:
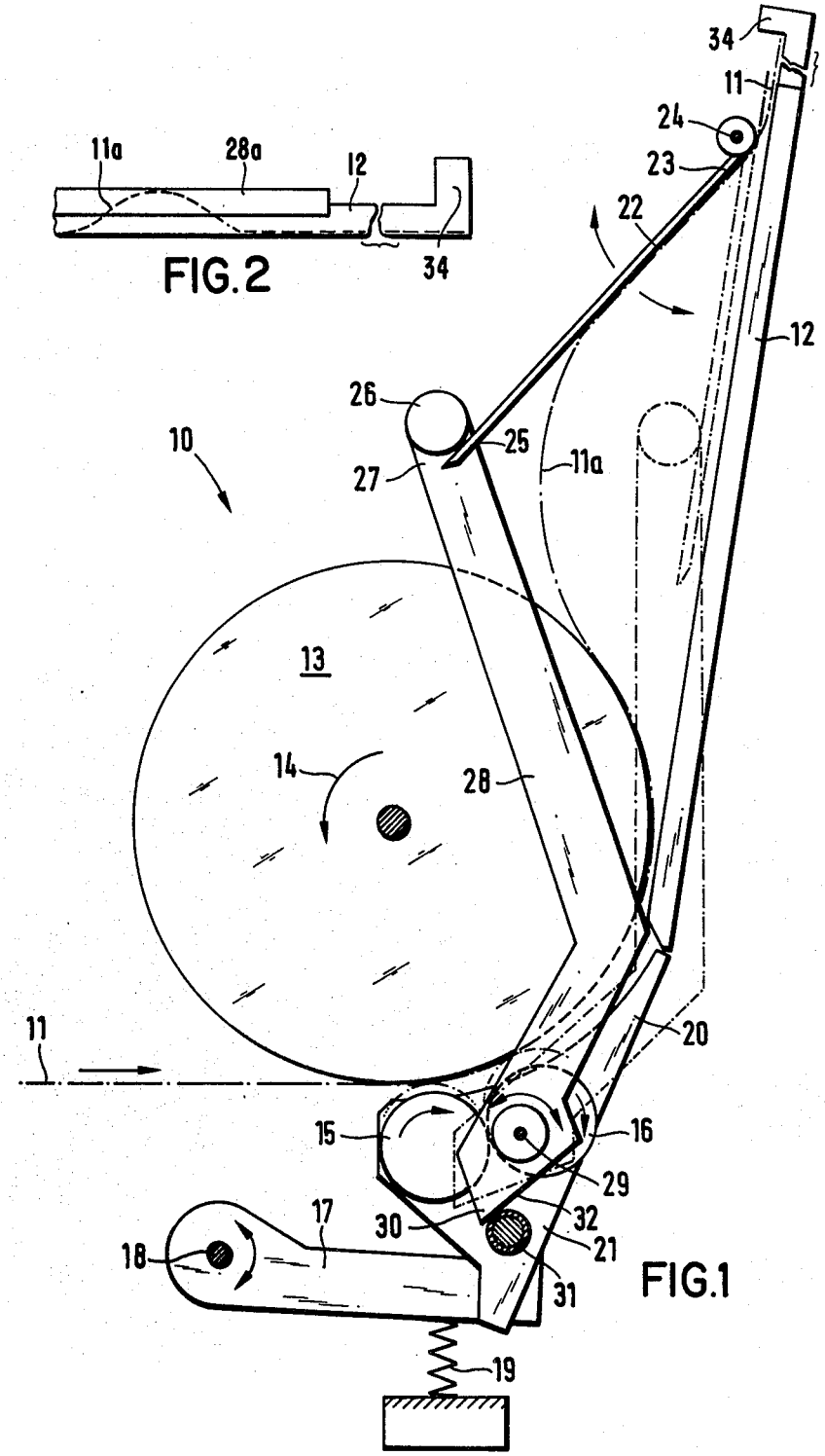
FIG. 1. is a lateral schematic view of the invention.
FIG. 2 is a schematic view of a modification of the invention.

Referring now to FIG. 1, a feed device according to the invention is designated as 10, whereby a strapping band 11, for example, a steel band or a plastic band is advanced through a band channel 12, which encircles the package to be strapped, whereof only the first section which is directly connected to the feed device 10, is illustrated in the drawing.

The feed device includes a feed roller 13 which is driven in the direction of arrow 14 by a drive not illustrated in more detail here, and two loosely running pressure rollers 15 and 16, which form the pressure device and which are rotatably mounted on a pressure lever 17 by bearing block 21. The pressure rollers 15 and 16 are rotatably connected to block 21, which is in turn rotatably connected to the pressure lever at a roller pivot 31. The pressure lever 17 is rotatably mounted on a pivot 18 and is under the effect of a pressure spring 19, which tends to rotate the pressure lever 17 counter-clockwise and press the pressure rollers 15 and 16 against the feed roller 13. The strapping band 11 is passed between the feed roller 13 and the pressure rollers 15 and 16 and is supported by a rear extension 20 on the bearing block 21 of the pressure roller 15 and 16 and guided into the band channel 12.

The band channel 12 in its front section shown here has a U-shaped cross-section and is open to the drive roller. It is covered behind the drive roller with a band guide strip 22 which is rotatably or swivel mounted at its one end 23 on a pivot 24 in the machine housing. The band guide strip presses against a back up roller 26 which is rotatably connected to the free end 27 of a disengaging lever 28.

The disengaging lever 28 is a swivel lever, which is supported in the machine housing by a shaft 29 and presses with its short, other end 30 against a roller pivot 31, which is located on the bracket or bearing block 21 for the pressure rollers 15 and 16 and rolls on a pressure surface 32 at the lower end 30 of the disengaging lever 28.

The operating mode of the device will now be described.

When the strapping band 11 is advanced resistance-free in the band channel 12, the pressure rollers 15 and 16, the disengaging lever 28 and the band guide strip 22 assume the position shown in the broken lines, wherein the pressure rollers 15 and 16 are pressed by the pressure spring 19 against the feed roller 13 and the band guide strip 22 covers the outer side of the band channel 12.

If the front end of the strapping band 11 contacts the stopping switch, not shown, or meets with any other obstacle, the feed roller 13 continues to run for a short period. Any such obstacle or switch is shown schematically in the drawings as stop 34. However, as the strapping band 11 cannot be further advanced, it buckles and comes out of the band channel 12 immediately behind the feed roller 13 and tends to form a loop 11*a*. Under the externally directed pressure of the band loop 11*a* thus formed, the band guide strip 22 is rotated on its pivot 24 outwards in a clockwise direction. The guide strip then presses against the back up roller 26, causing the disengaging lever 28 to be rotated counterclockwise on its shaft 29. The lower end 30 of disengaging lever 28 thus presses on the roller pivot 31, which then rolls on the surface 32 of the disengaging lever 28. The pressure lever 17 is thereby rotated in a clockwise direction about its pivot 18 causing the pressure rollers 15 and 16 to be withdrawn from the feed roller 13. This condition is shown in the drawing in solid lines.

As soon as the pressure rollers 15 and 16 are removed from the feed roller 13, the latter can exert no more feed power to the strapping band 11. The band 11 then slides back past the feed roller 13 to the supply roller, not shown, by moving in a direction opposite to the normal direction of feed as the band 11 tends to resume its extended flat position due to its own elasticity and thus eliminate the loop 11*a* which was formed. After the band loop 11*a* is eliminated, the pressure spring 19 tends to press the pressure rollers 15 and 16 against the feed roller 13 again, which in turn rotates the disengaging lever 28 in a clockwise direction back to its initial position, which pushes the strapping band 11 again into the band guide channel 12. In order to assist resuming normal feed operation, the band guide strip 22 can be under the effect of a torsion spring (not shown), which is placed around the pivot 24 and which tends to rotate the band guide strip 22 counterclockwise.

The invention is not restricted to the preferred embodiment herein described. For example, it is possible to form a disengaging lever 28*a* in such a manner that it covers part of the band channel 12 and is directly rotated by the band loop 11*a* which is formed, as shown in FIG. 2.

While the present invention has been thus illustrated and described, it is to be understood that various changes and modifications may be made within the scope and spirit of the invention.

What is claimed is:

1. A feed device, for strapping bands for use in a strapping machine, which comprises:

a band channel having a stop at one end thereof;

a pressure device;

a drive-operated feed roller which cooperates with said pressure device which pushes the strapping band through said band channel as far as said stop; and a disengaging lever operatively connected to said pressure device, movable by a band loop in the strapping band formed in said band channel and which moves said pressure device with respect to the feed roller.

2. The device of claim 1, which further includes a band guide strip, wherein said disengaging lever is moved by said band guide strip which covers a part of said band channel and which is displaced by said band loop.

3. The device of claim 1 or 2, which further includes a spring, wherein said disengaging lever is pivotally connected to said pressure device, which removes said pressure device against the pressure of said spring from said feed roller.

4. The device of claim 3 wherein said band guide strip is pivotally connected at one end thereof to said strapping machine, said disengaging lever has a back up roller rotatably mounted at one end thereof, and said band guide strip frictionally engages said back up roller thereby permitting said band guide strip to move said disengaging lever when it is caused to rotate about its pivot point.

5. The device of claim 4, which further includes a spring-loaded pressure lever, wherein said pressure device is located on said spring-loaded pressure lever which includes a stop upon which said disengaging lever acts.

6. The device of claim 5 wherein said disengaging lever covers a part of the band channel and is directly moved by the loop formed by the band.

7. The device of claim 6 wherein said pressure device includes a roller.

* * * * *